US005121618A

United States Patent [19]

Scott

[11] Patent Number: 5,121,618

[45] Date of Patent: Jun. 16, 1992

[54] ATTACHMENT FOR TRANSFORMING LOCK CYLINDERS INTO INTERCHANGEABLE CORES

[76] Inventor: Rita Scott, 1096 Casitas Pass Rd. #307, Carpinteria, Calif. 93013

[21] Appl. No.: 736,075

[22] Filed: Jul. 25, 1991

[51] Int. Cl.[5] ..... E05B 27/00

[52] U.S. Cl. ..... 70/367; 70/371; 70/386; 70/422

[58] Field of Search ..... 70/367-369, 70/370-371, 386, 422, 373-375

[56] References Cited

U.S. PATENT DOCUMENTS

| | | | |
|---|---|---|---|
| 701,850 | 6/1902 | Cramond | 70/374 |
| 1,832,108 | 11/1931 | Falk | 70/369 |
| 1,964,787 | 7/1934 | Voight | 70/369 |
| 2,058,895 | 10/1936 | Lowe | 70/370 |
| 2,061,456 | 11/1936 | Falk | 70/369 |
| 2,206,958 | 9/1965 | Best | 70/369 |
| 2,525,344 | 10/1950 | Garniss | 70/386 X |
| 3,261,189 | 7/1966 | Best | 70/369 |
| 3,324,693 | 6/1967 | Check | 70/369 |
| 3,391,555 | 7/1968 | Mamo | 70/371 X |
| 4,063,434 | 12/1977 | Moberg | 70/386 X |
| 4,545,224 | 10/1985 | Zane | 70/371 X |
| 4,672,827 | 6/1987 | Craig | 70/367 |
| 4,697,444 | 10/1987 | Maffey | 70/371 X |
| 4,901,544 | 2/1990 | Jang | 70/386 X |
| 4,964,494 | 10/1990 | Eisermann | 70/369 X |
| 4,995,249 | 2/1991 | Preissler et al. | 70/224 |
| 5,040,652 | 8/1991 | Fish et al. | 70/386 X |

FOREIGN PATENT DOCUMENTS

| | | | |
|---|---|---|---|
| 1526304 | 9/1978 | United Kingdom | 70/386 |

*Primary Examiner*—Renee S. Luebke
*Assistant Examiner*—Suzanne L. Dino
*Attorney, Agent, or Firm*—David Pressman

[57] ABSTRACT

An attachment (9) which transforms a lock cylinder having a cylinder housing (30), an aligning bracket (27), and a cylinder core 41*a* into a lock cylinder with an interchangeable core (40*a*). The interchangeable core (40*a*) is held in place and is attached to the interchangeable attachment (9) using a conventional cylinder core nut (21). With a control key (50) inserted into the cylinder keyway (42) within an interchangeable core (40*a*), a push rod (51) comes into contact with a plunger head (19) at the front end of the plunger (11). The plunger (11) is pushed back, allowing the locking balls (13) to recede into the inward position; at this point, the only thing holding the interchangeable core lock cylinder (40*a*) in the cylinder housing (30) is the security back-up pin (14). With the control key (50) inserted, turn right five degrees and pull. The interchangeable core lock cylinder (40*a*) will come out. A new interchangeable core lock cylinder (40*a*) can be inserted using the same procedure.

20 Claims, 8 Drawing Sheets

ATTACHMENT FOR TRANSFORMING LOCK CYLINDERS INTO INTERCHANGEABLE CORES

BACKGROUND

Field of the Invention

This invention relates generally to locks, specifically to an attachment for transforming a lock cylinder to have an interchangeable core.

BACKGROUND

Description of Prior Art

It is desirable to have a lock with a core that can be readily removed from its cylinder in a simple and convenient manner. The interchangeable core must be quickly releasable and maintain a high degree of security. Specifically, it must be able to withstand tampering or picking and still allow authorized individuals to interchange cores easily and conveniently.

There have been several interchangeable core lock cylinders devised, but each has one or more significant drawbacks.

One such device, shown in U.S. Pat. No. 1,832,108 to M. Falk (1931), shows an interchangeable core where the lock's top driver pins stay in the cylinder when the core is removed, thus leaving the bottom and master pins exposed where they can spill out, making it impractical to interchange lock cores. This is a significant drawback because it makes it necessary for a professional locksmith to do rekeying on the premises. Also, it is expensive and time consuming. Since a lock's effectiveness in maintaining security depends on the speed at which locks are changed or rekeyed, security is greatly compromised by such a device.

Furthermore, the device has a cam connected to the outside end of the cylinder housing. This makes it necessary to completely remove the cylinder housing from the lock in order to service or repair the cam. Also, the cam is held to the cylinder housing by two screws on the back side. With this type of cam connection, the screws have a tendency to come loose and it is necessary to crimp or stake the edges of the screws with a center punch or some equivalent tool. This makes removing them more difficult and is more time consuming, expensive, and inconvenient. Finally, the Falk device cannot be interchanged with other type cylinder housings because the upper pins and springs constitute a permanent part of the cylinder housing.

H. G. Voight, in U.S. Pat. No. 1,964,787 (1934), shows an interchangeable core for a pin tumbler-type lock. This removable core is held into the housing using a spring-loaded pin within the rear of the cylinder housing. In order to remove the interchangeable core, the control key incorporates an extended surface at the bottom of each key cut, whereupon the bottom pins rest. These extended surfaces create a major drawback because they drastically reduce the number of combinations the key can use. As a result, the effectiveness of such a key in security and its usefulness in large key systems are greatly reduced.

M. Falk, in a later U.S. Pat. No. 2,061,456 (1936), shows a wafer tumbler lock with a removable plug. This device exhibits some of the same disadvantages as other prior-art locks described above. In addition, an unauthorized individual can easily remove the core by using a simple paper clip or other wire type device, thus greatly reducing security.

F. E. Best, in U.S. Pat. No. 3,706,958 (1965), shows a pin tumbler interchangeable core comprising a retaining lug within the cylinder housing. As a result, two shear lines are created. This is a major drawback because mathematically speaking, it greatly increases the difficulty factor when rekeying. Also, this device is configured in such a way that the pin and springs have to be installed from the top of the cylinder housing and then capped with special plugs. This makes rekeying more difficult, awkward and time consuming.

F. E., in a later U.S. Pat. No. 3,261,189 (1966), Best shows a removable core pin tumbler lock with a single shear line. This interchangeable core has many of the disadvantages of the other devices. Furthermore, this device is designed so the core will come out when the master key is only partially inserted into the keyway. This is a disadvantage because an individual could accidentally remove the cylinder from the housing. Moreover, this cylinder can turn clockwise only to operate the lock mechanism. This is yet another disadvantage, because many locks turn both ways to lock and unlock.

M. M. Check, in U.S. Pat. No. 3,324,693 (1967), shows a pin tumbler interchangeable core with many of the disadvantages of the others. In addition, it incorporates a ward to control the keys. This is costly because a ward recess has to be made in the housing and also in the plug itself.

C. E. Craig in U.S. Pat. No. 4,672,827 (1987), shows a removable core wafer lock. This lock cylinder has many disadvantages in common with the Falk wafer cylinder of U.S. Pat. No. 2,061,456, supra.

OBJECTS & ADVANTAGES

Accordingly, several objects and advantages of the invention are to provide an attachment for transforming standard lock cylinders with non-interchangeable cores into lock cylinders having interchangeable cores (hereinafter referred to simply as an "attachment"), the attachment being simple in construction, reliable in operation, self-contained, and totally independent of the cylinder housing. Moreover, such an attachment can be easily and conveniently removed and rekeyed by a lay person without having to remove the cylinder housing, providing a lock cylinder housing with an opening all the way through to the inner workings of the lock mechanism for easy and convenient lubrication. Further the lock has additional security features which make it impossible for an unauthorized person to remove the attachment without a special control key. Further objects and advantages of the invention will become apparent from a consideration of the ensuing description and the accompanying drawings.

DRAWING REFERENCE NUMERALS

Figure 1A:
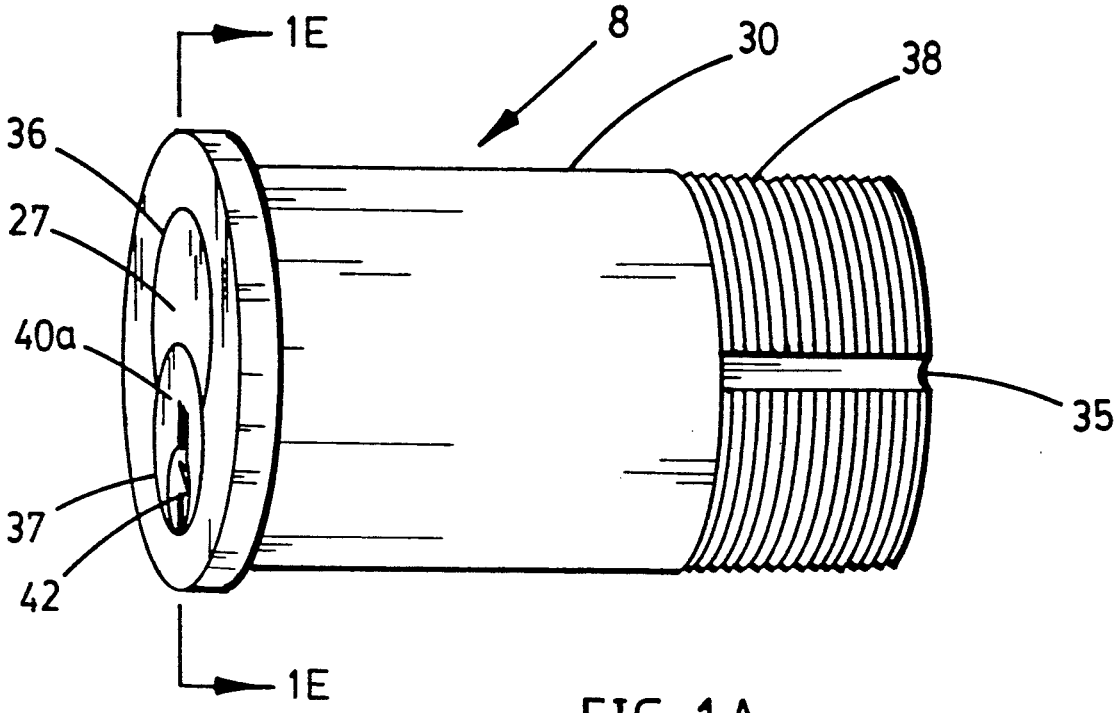
FIG. 1A is an overall perspective view of a standard lock cylinder which has been transformed to have a interchangeable core according to the invention.

8 Core lock cylinder assembly
9 Transforming attachment
10 Transforming attachment body
**10*a*** Inner wall
11 Plunger
**11*b*** Plunger tapered portion
12 Plunger spring
13 Locking ball
14 Security back-up pin
15 Cam screw
16 Conventional cylinder lock nut pin access groove
**17, 17*a*** Cam
18 Plunger access hole
**18*a*** Cam connecting hole
**18*b*, 18*f*** Plunger spring aligning hole
**18*c*** Cam screw access hole
**18*d*** Locking ball access hole
19 Plunger head
20 Cylinder lock nut pin
21 Conventional cylinder lock nut
**21*a*** Transforming attachment hole
22 Female threaded recess
**22*a*** Threaded end of the core
23 Notched hole
24 Flange
25 Cylinder lock nut spring
26 Cam screw threads
27 Aligning bracket
**29*a*** Plunger retaining crimp
**29*b*** Ball retaining crimp
30 Cylinder housing
31 Ball-retaining recess
32 Security back-up pin groove
33 Security back-up pin and cam access space
34 Transforming attachment access hole
35 Retaining screw slot
36 Aligning bracket space
37 Semicylinder space
38 Housing male threads
40 Conventional non-interchangeable core lock cylinder
**40*a*** Transformed interchangeable lock core
**40*b*** Cylindrical portion
**40*c*** Rectangular radial projection
**40*d*** Recess
**40*f*** Lock core
41 Conventional cylinder male threads
42 Cylinder keyway
43 Cylinder springs
44 Top driver springs
45 Bottom pins
**45*a*** Through holes
47 Conventional non-interchangeable core lock cylinder cam
50 Control key
51 Push rod
52 Standard key

Figure 5A:
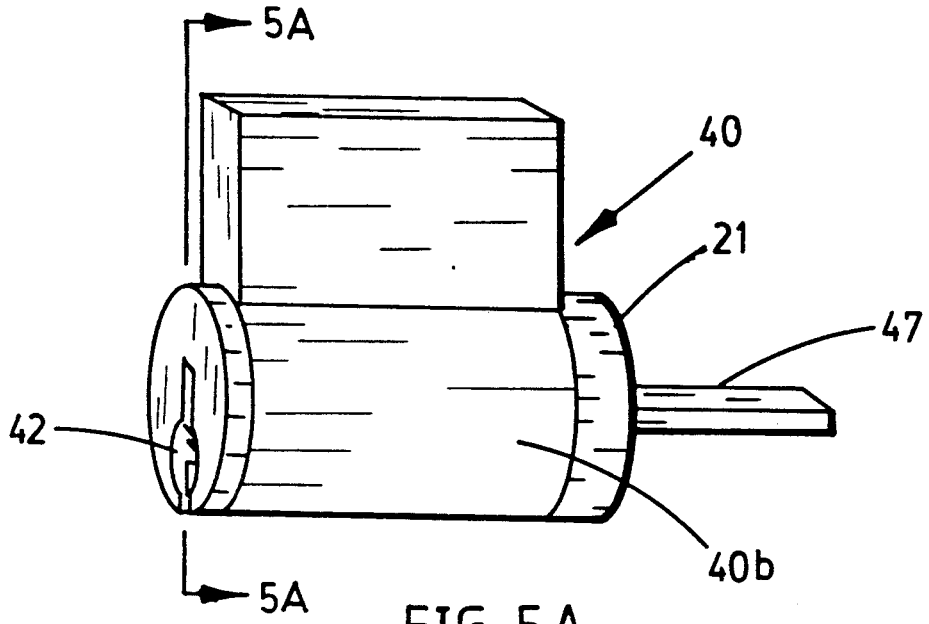
FIG. 5A is a perspective view of a standard non-interchangeable core cylinder.
Figure 5B:
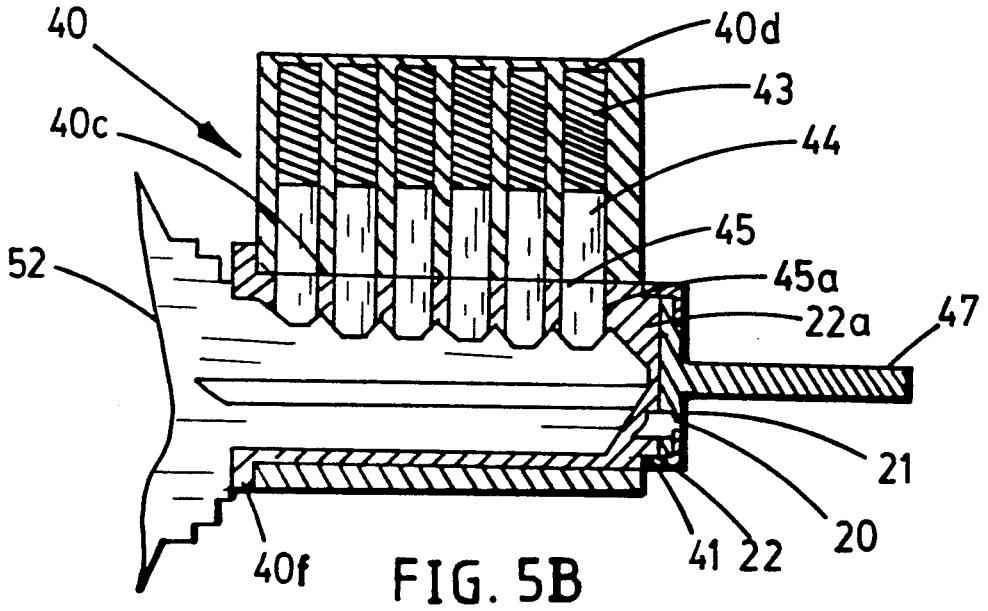
FIG. 5B is a sectional view along lines 5A—5A of the core cylinder of FIG. 5A with a standard key of FIG. 4A inserted.
Figure 5C:
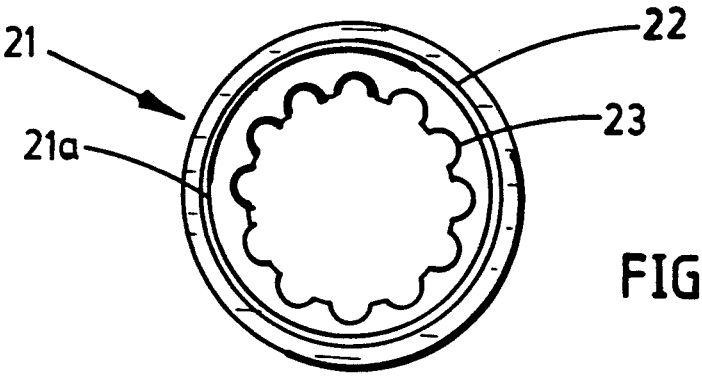
FIG. 5C is an end view of a conventional cylinder lock nut from the side of the key.

DESCRIPTION OF CONVENTIONAL LOCK WITH NON-INTERCHANGEABLE CORE FIGS. 5A, 5B, AND 5C

In order to better understand the structure and principle of operation of the interchangeable core lock of the invention, it is useful first to describe the construction and operation of a non-interchangeable core cylinder used in a conventional tumbler pin-type lock.

Figure 4A:
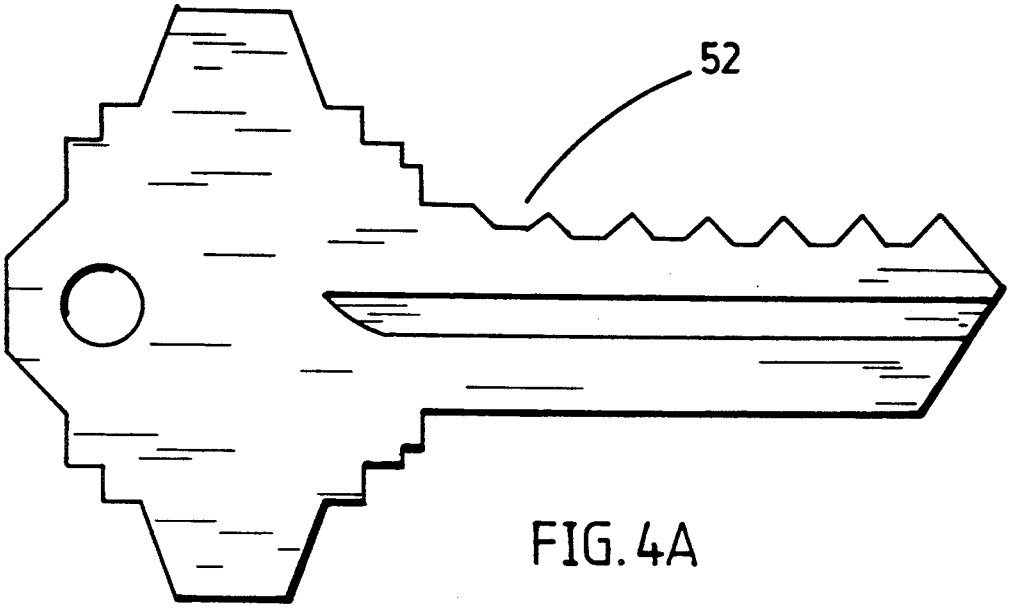
FIG. 4A is a view of a standard key.

Such a conventional lock core cylinder and its parts are shown in the drawings, where FIG. 5A is a perspective view of a lock core cylinder, FIG. 5B is a sectional view along lines 5A—5A of the lock core cylinder of FIG. 5A with a standard key of FIG. 4A inserted; and FIG. 5C is an end view of a conventional cylinder lock nut from the side of the key.

As shown in the abovementioned drawings, a conventional lock core cylinder 40 consists of a cylindrical portion **40*b* with a rectangular projection 40*c* which extends radially outwardly in the upward direction and contains recesses 40*d*. These recesses, in turn, accommodate top driver pins 44 and cylinder springs 43 located between the bottom of recesses 40*d* and upper ends of top driver pins 44. Cylindrical portion 40*b* of the lock core cylinder contains a cylindrical lock core 40*f* with a cylinder keyway 42 extended in the longitudinal direction of cylindrical portion 40*b***.

Cylindrical lock core **40*f* has in its wall through holes 45*a* which are aligned with the abovementioned recesses 40*d* and contains bottom pins 45**.

Cylindrical lock core **40*f* has on its back side a cylinder lock nut 21 (best seen in FIGS. 5C). As indicated in FIG. 5C, cylinder lock nut 21 is annular in shape and has a female threaded recess 22 at the front end and a notched hole 23 in its rear wall. Lock nut is screwed onto an external thread 41 made on a threaded rear end 22*a* of cylinder lock core 40*f* and is fixed by lock nut pin 20. It has a notched hole 23** (best seen in FIG. 5C).

Made integrally with lock nut 21 is a lock cylinder cam 47, which in the illustrated example extends outwardly axially from the rear of the lock nut. This cam is intended to activate the locking through an appropriate lock mechanism (not shown in the drawings).

The lock operates in the following manner: when a correct key 52 is inserted into keyway 32, each tooth of the key functions as a cam which acts upon a corresponding bottom pin 45, urging it upward, together with its appropriate top driver pin 44, against the force of cylinder springs 43. If the key matches, a shear line between bottom pins 45 and top driver pins 44 coincides with the outer cylindrical surface of core 40*c*, so that there are no obstacles to the free rotation of core 40*f* by a turn of the key. As cylindrical core 40*f* rotates, it also turns cylinder lock nut 21, together with core lock cylinder cam 47. This, in turn will move the latch (not shown) from its slot, and the door or other locked device can be opened.

Having now described the basic construction and operation of a standard cylindrical tumbler pin-type lock, we shall begin to describe the present invention using the same terms. As the interchangeable core of the invention can be made by attaching several additional parts to a conventional core of the type shown in FIGS. 5A, 5B, and 5C, those parts of the core of the invention which are identical with corresponding parts of the conventional core will be designated by the same reference numerals.

DESCRIPTION OF PARTS OF LOCK CORE ATTACHMENT

FIGS. 1 through 4

The interchangeable lock core attachment of the invention for transforming a conventional lock core, such as shown in FIG. 5, into an interchangeable one will now be described with reference to the accompanying drawings (FIGS. 1 through 4). FIG. 1A is an overall perspective view of a standard lock cylinder which has been transformed to have an interchangeable core according to the invention; FIG. 1B is a perspective view of the transformed cylinder with an interchangeable core and an aligning bracket connected; FIG. 1C is a perspective view of the aligning bracket; FIG. 1D is a perspective view of the lock cylinder with an attachment connected; FIG. 1E is a longitudinal sectional view taken along lines 1E—1E of FIG. 1A showing the entire core cylinder inside a cylinder housing, the device being shown with a standard key inserted; FIG. 1F is a sectional view similar to the one of FIG. 1E, but with a control key inserted.

A lock cylinder assembly 8 of the invention (FIG. 1A) generally consists of a cylinder housing 30, an aligning bracket 27 inserted into housing 30, and a replaceable attachment 9 (FIG. 1D) having at its rear end a cam 17A for engagement with a latch via an appropriate mechanism (not shown). In contrast to the conventional lock core of FIGS. 5A–C, lock cam 17A is shown in the form of a radial, rather than axial, extension from lock nut 21.

Each of the above elements will now be considered in detail separately.

Figure 3A:
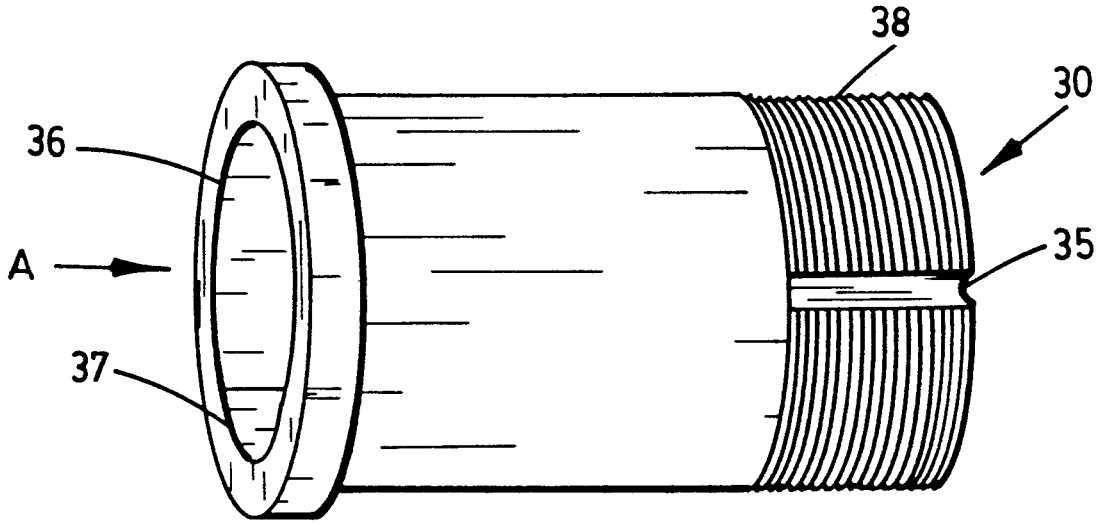
FIG. 3A is a perspective view of a cylinder housing of FIG. 1A, with the core removed.
Figure 3B:
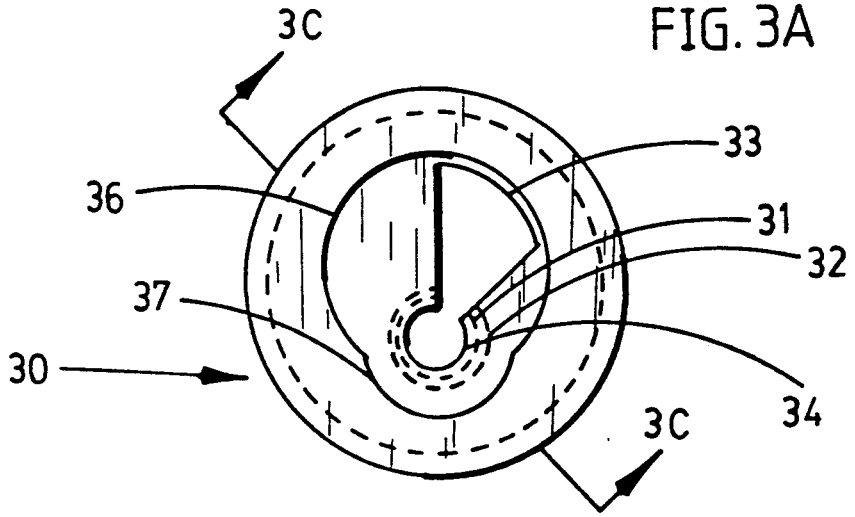
FIG. 3B is a front-end view of the cylinder housing in the direction of arrow A of FIG. 3A.
Figure 3C:
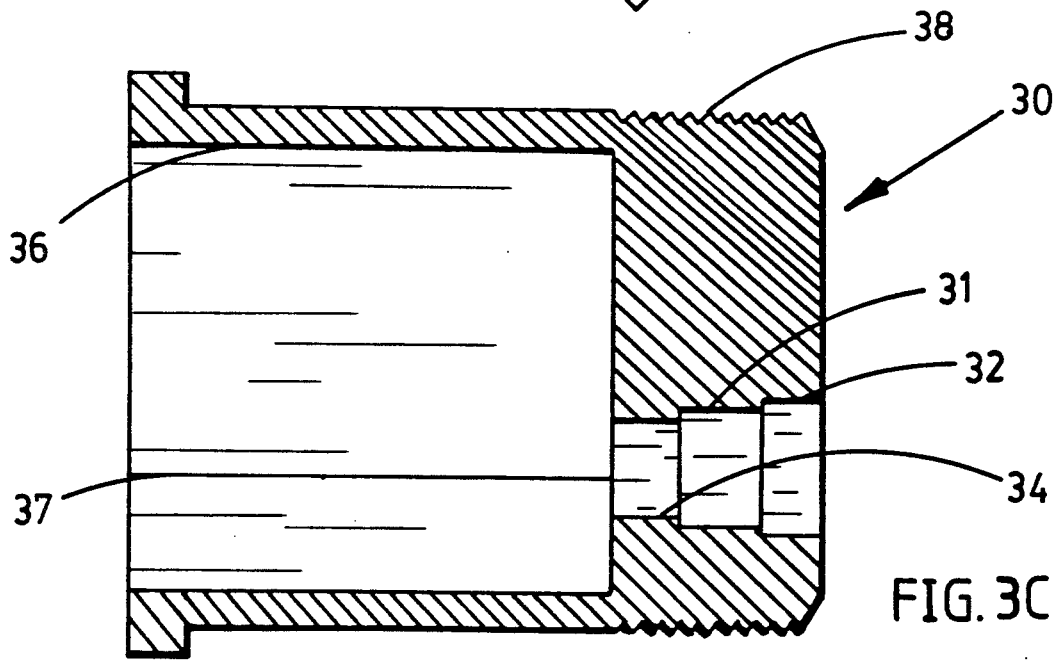
FIG. 3C is a sectional view of the cylinder housing of FIG. 3B taken along line 3C—3C of FIG. 3B.

Cylinder housing 30 is best seen in FIGS. 3A, 3B, and 3C. FIG. 3A is a perspective view of a cylinder housing of FIG. 1A with the core removed; FIG. 3B is a front-end view of the cylinder housing in the direction of arrow A of FIG. 3A; and FIG. 3C is a sectional view along lines 3A—3A of the cylinder housing of FIG. 3B. The housing is cylindrical in shape and has an open front end with an opening 36 for aligning bracket 27 and a closed rear end with an access hole 34 for attachment 9. Opening 36 is offset upwardly from the central axis of cylindrical housing 30 and has a semicylindrical recess 37 in the bottom portion of opening 36 to receive a portion of interchangeable attachment 9.

Apart from access opening 34, on its rear end housing 30 has external threads 38, a retaining slot 35 for a security back-up pin 14 (FIG. 1B), a cam access space 33 (FIG. 3B), a security back-up pin groove 32, and an annular ball-retaining recess 31 (FIGS. 3B and 3C). Security backup pin 14 is located at the top of body 10, on a level with inner wall 10*a* and about five degrees to the left side.

Cam access space 33 is formed in the upper right rear, extending all the way through cylinder housing 30, and is centered inside cylinder bore 37 (best seen in FIG. 3C). Ball-retaining recess 31 and security back-up pin groove 32 are bored from the back side of the cylinder housing and are centered with core access hole 34 (best seen in FIG. 3C).

Figure 2A:
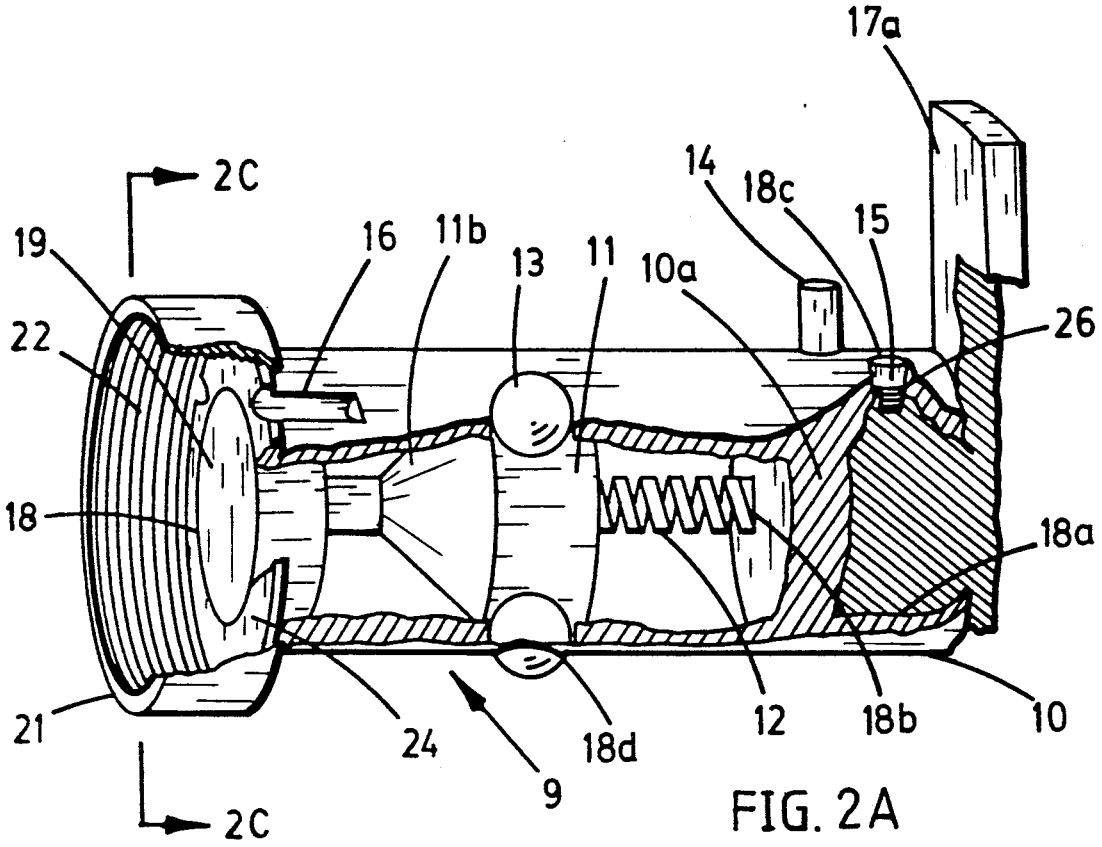
FIG. 2A is a perspective view, partly in section, of the attachment of FIG. 1D.
Figure 2B:
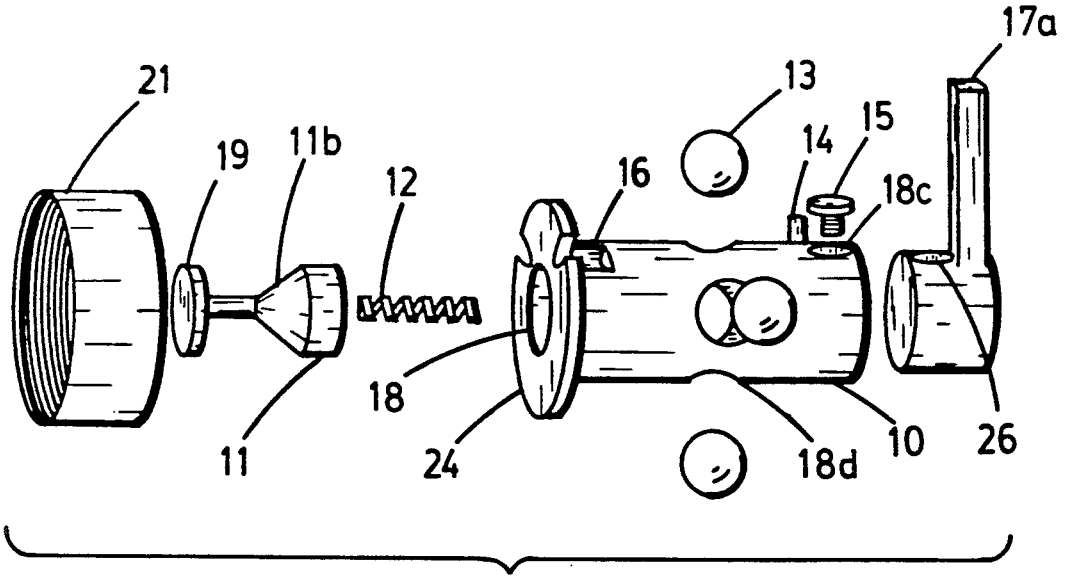
FIG. 2B is an exploded perspective view of the attachment of FIG. 2A.

As shown in FIGS. 2A and 2B, interchangeable lock core attachment 9 has a hollow cylindrical body 10 with a rear wall 10*a* at its rear end and a flange 24 at its front end. Cylindrical body 10 is slightly smaller in diameter than notched hole 23 in conventional cylinder lock nut 21 (best seen in FIG. 5C), so that the cylinder body can freely slip through the abovementioned notched hole.

Figure 2C:
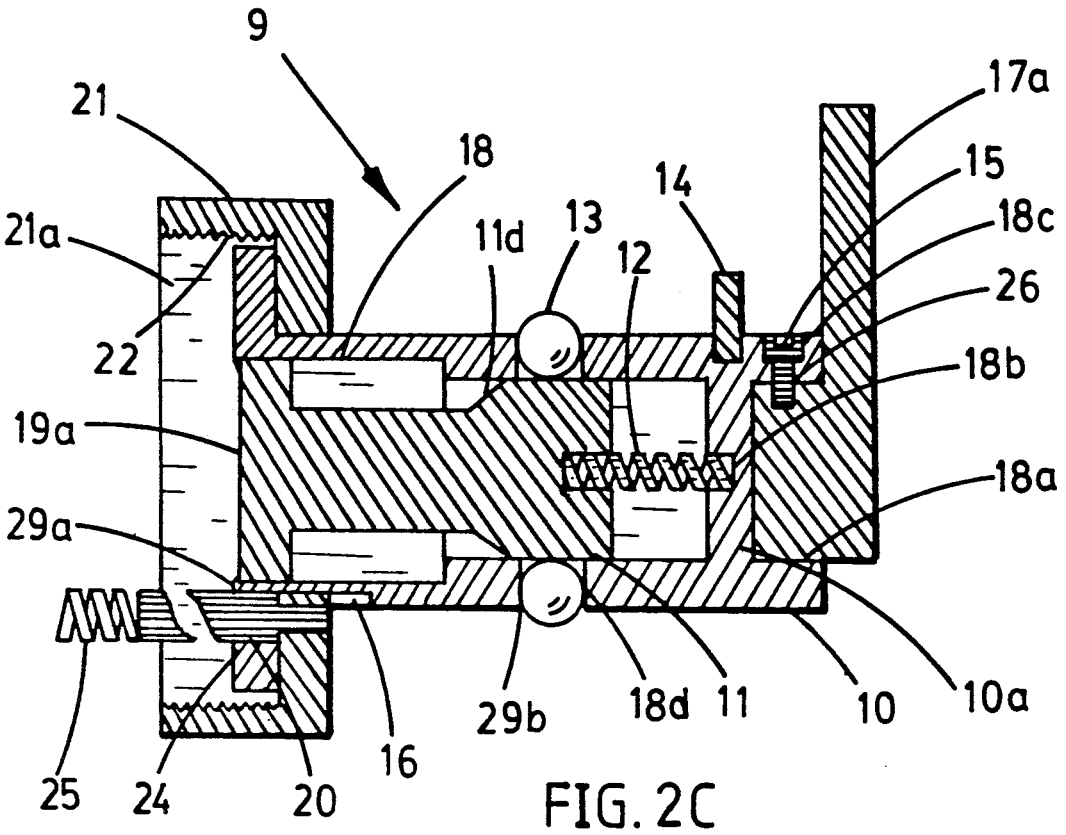
FIG. 2C is a sectional view of the attachment taken along line 2C—2C of FIG. 2A, with a plunger and balls in core-locking position.
Figure 2D:
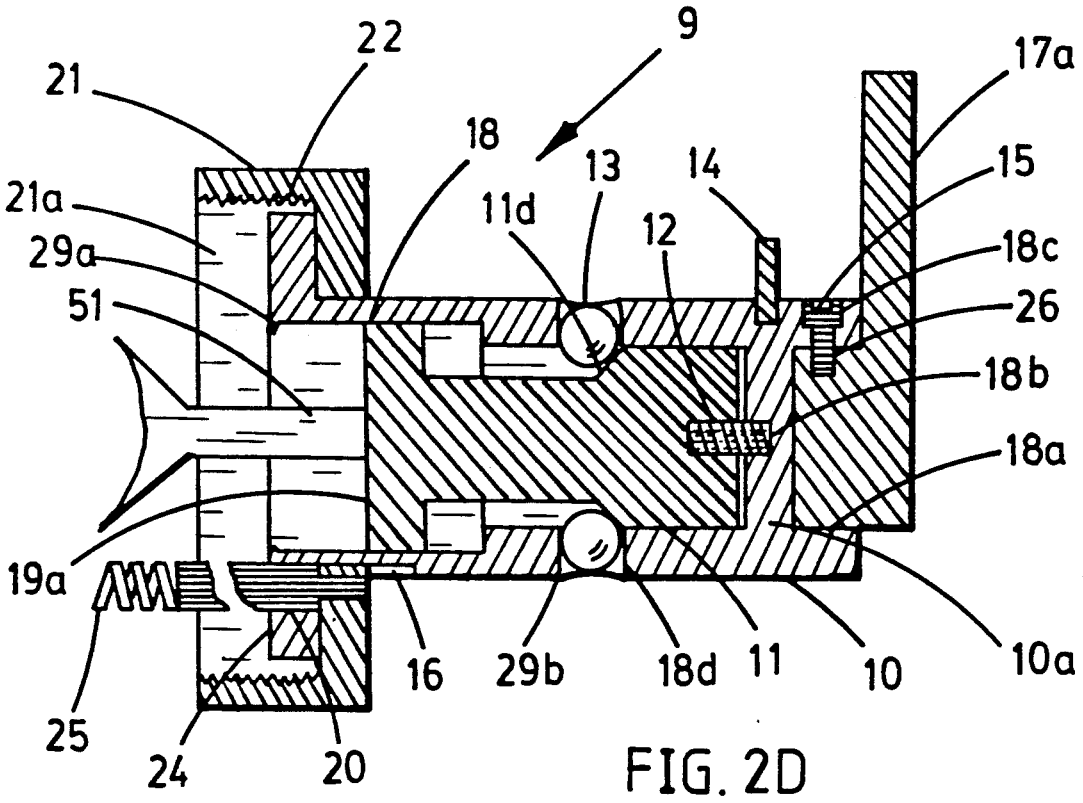
FIG. 2D is a view similar to FIG. 2C, but with the plunger and the balls in the core-releasing position.

Flange 24 has a plunger access hole 18 which extends about two-thirds the length of cylindrical body 10, while on the end opposite to flange 24 the cylindrical body has a cam receiving hole 18*a*. Cam receiving hole 18*a* is bored in the back end of the body 10 and does not extend all the way through to plunger access hole 18; thus, inner wall 10*a* is formed. A plunger spring aligning hole 18*b* is formed on the front side of rear wall 10*a*, and a cam screw access hole 18*c* is formed in the wall of cylindrical body 10 near its rear end. Another spring aligning hole 18*f* is formed on the end of plunger portion 11 (FIG. 2C).

Approximately halfway between front end flange 24 and inner wall 10*a* are four locking ball access holes 18*d* located evenly around cylindrical body 10. A locking ball 13 sits inside each access hole 18*d*, resting on a plunger 11.

Plunger 11 is an essential feature of the interchangeable lock core mechanism of the invention. It has a head 19, which in an assembled state of the lock is inserted into plunger access hole 18 of the lock nut, and a tapered portion 11*b* which slides inside a reduced-diameter portion 18*e* of the plunger access hole.

Plunger 11 cannot be completely withdrawn from the cylindrical body because of plunger-retaining crimps 29*a* (FIG. 2D) which are formed at a factory after assembling attachment 9.

Security backup pin 14 is located at the top of body 10, even with inner wall 10*a* and about five degrees to the left side. Cam screw access hole 18*c* is located midway between inner wall 10*a* and the end of body 10 at the top in the center. Cam 17 fits into cam connection hole 18*a* at the base and extends up at a right angle or straight, depending on the function of the lock it is to activate. Cam screw 15 screws into cam screw threads 26 in the base of cam 17 through cam access screw hole 18*c*.

In an assembled state of the lock, flange 24 of cylindrical body 10 keeps conventional cylinder lock nut 21 from coming off and holds cylindrical body 10 securely to conventional cylinder male threads 41 (best seen in FIG. 5B).

Figure 1B:
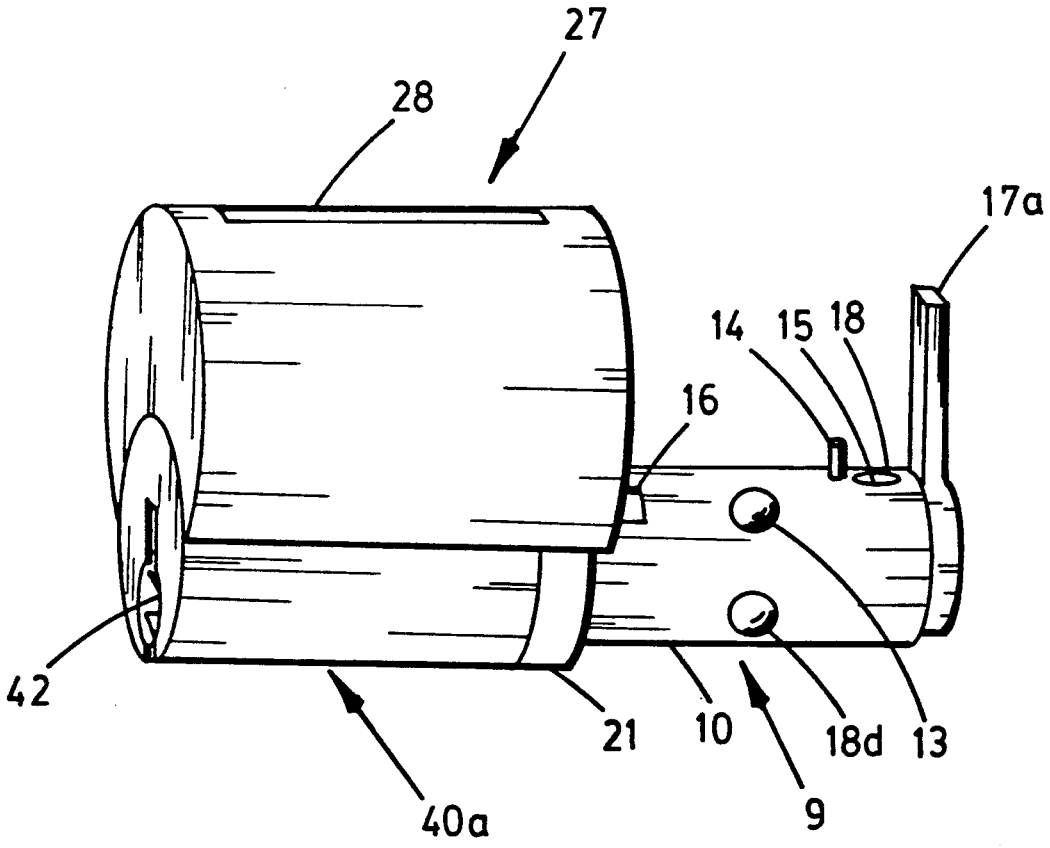
FIG. 1B is a perspective view of the transformed cylinder with an interchangeable core and an aligning bracket connected.
Figure 1C:
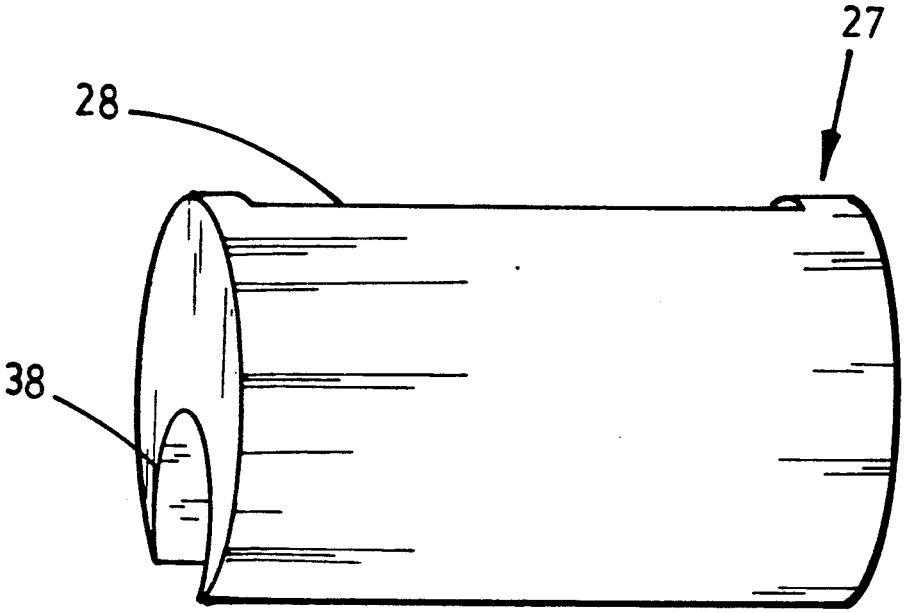
FIG. 1C is a perspective view of the aligning bracket.
Figure 1D:
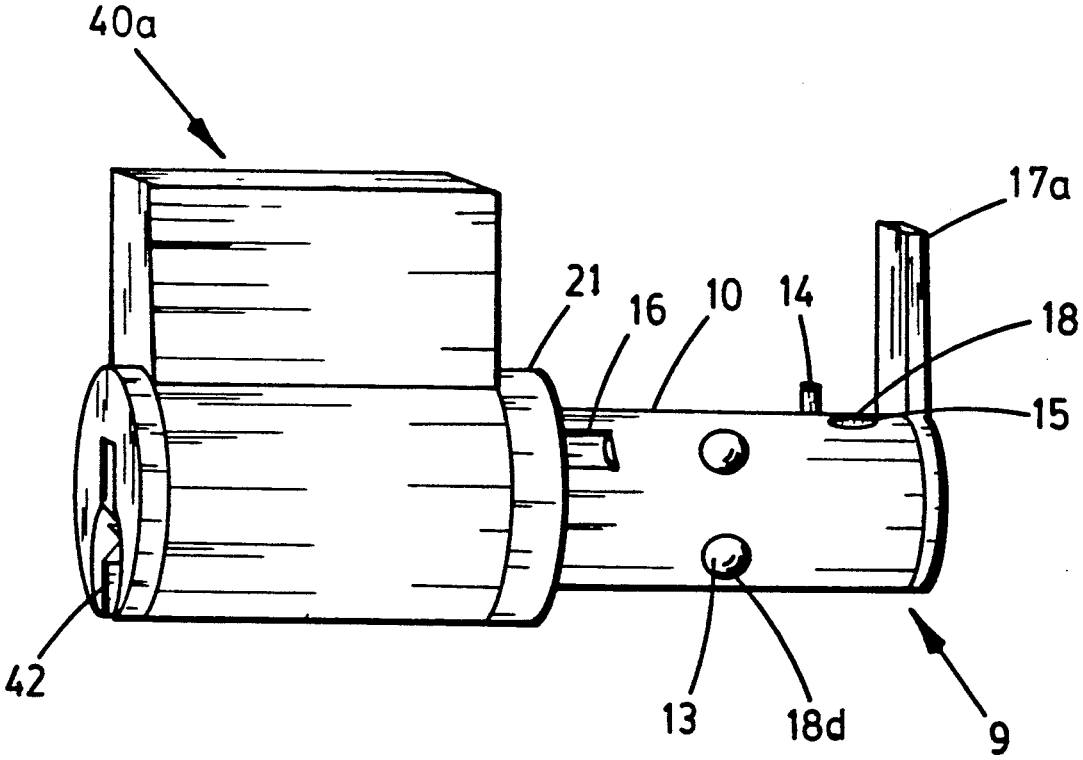
FIG. 1D is a perspective view of the lock cylinder with an attachment connected.

Aligning bracket 27, as indicated in FIG. 1C, is cylindrical in shape and its bottom forms a semicylindrical space 37, with an aligning space 28 drilled vertically through the center portion where radial projection 40*c* of conventional core lock cylinder 40 fits snugly (best seen in FIG. 1B).

Figure 4B:
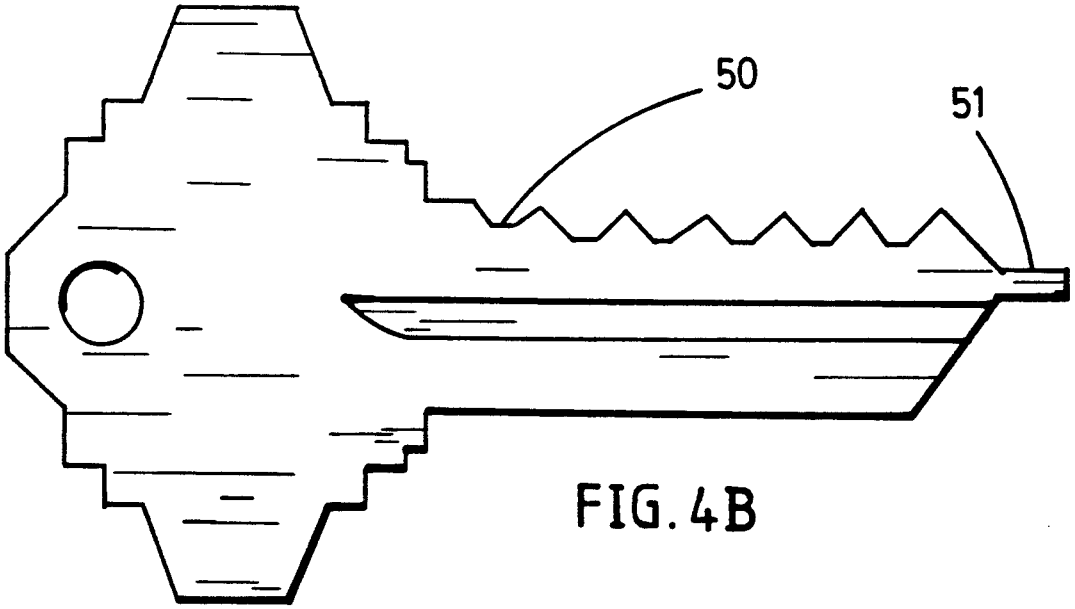
FIG. 4B is a view of a control key.

A control key 50, which is shown in FIG. 4B is like standard key 52 shown in FIG. 4A, but has a push rod 51 at its tip.

INSTALLATION

The conventional non-interchangeable lock core of the type shown in FIGS. 5A-5C can be transformed into a lock core of the invention (FIGS. 1A through 1F). Such a lock core can be interchanged with the use of control key 50. To do this, it is necessary to push on lock nut pin 20 with a piece of wire (not shown), thereby to release lock nut 21 from free rotation. Lock nut 21 is unscrewed then from external thread 22*a* formed on the end of lock core 40*a*, removed, and the conventional cam, e.g., of the type shown in FIG. 5B by reference numeral 17, is replaced by attachment 9 of the invention. For this purpose flange 24 of hollow cylindrical body 10 is placed into plunger access hole 18 and rests on the inner bottom surface of lock nut 21, while hollow cylindrical body 10 protrudes outwardly through the central hole of the lock nut. Now rotation of the key will be transmitted to cam 17A through interchangeable core 40*f* and disconnectable attachment 9.

In FIG. 1A, core lock cylinder 10*a* with accompanying aligning bracket 27 and attachment 9 is shown installed in a mortise-type cylinder housing 30. In this specific example, cylinder housing 30 has a diameter of about 25 mm. The length of the entire assembly which consists of transformed lock core 40*a* and attachment 9 is about 55 mm. Push rod 51 of the key had a length of about 6 mm.

OPERATION

Figure 1E:
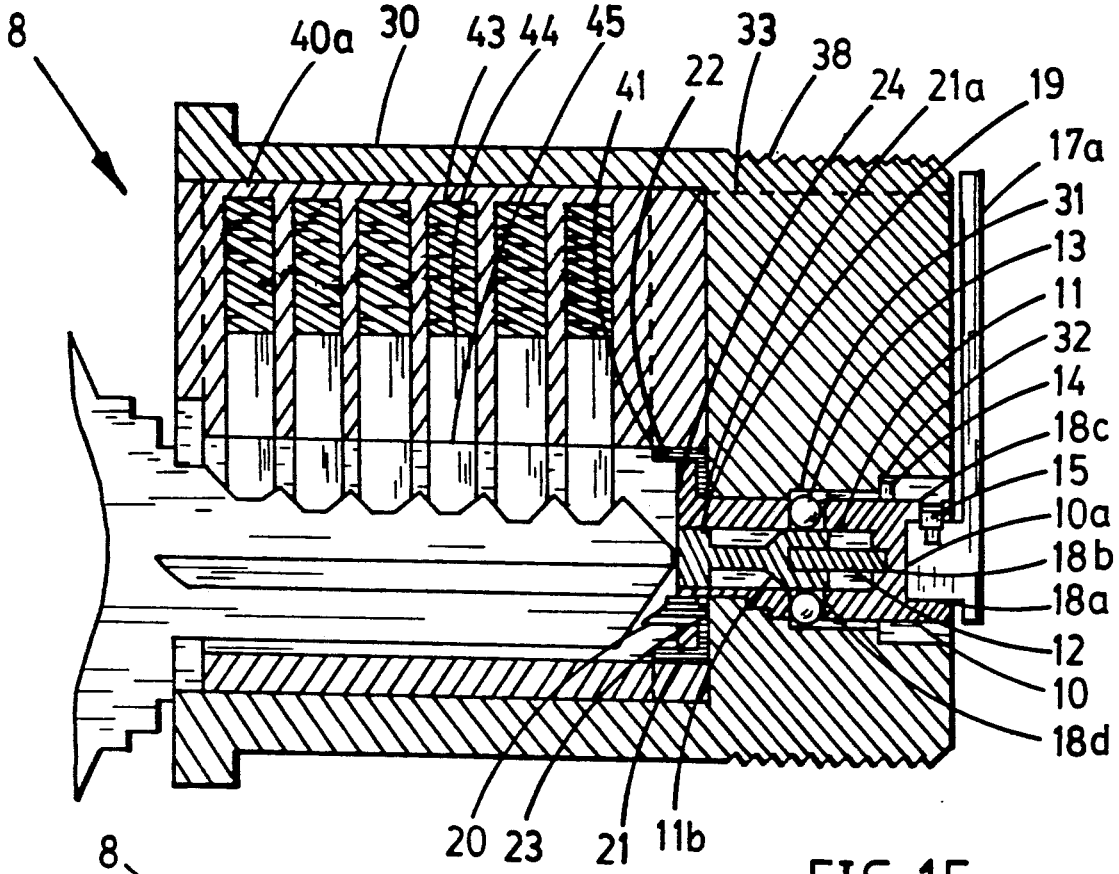
FIG. 1E is a longitudinal sectional view taken along lines 1E—1E of FIG. 1A showing the entire core cylinder inside a cylinder housing, the device being shown with a standard key inserted.
Figure 1F:
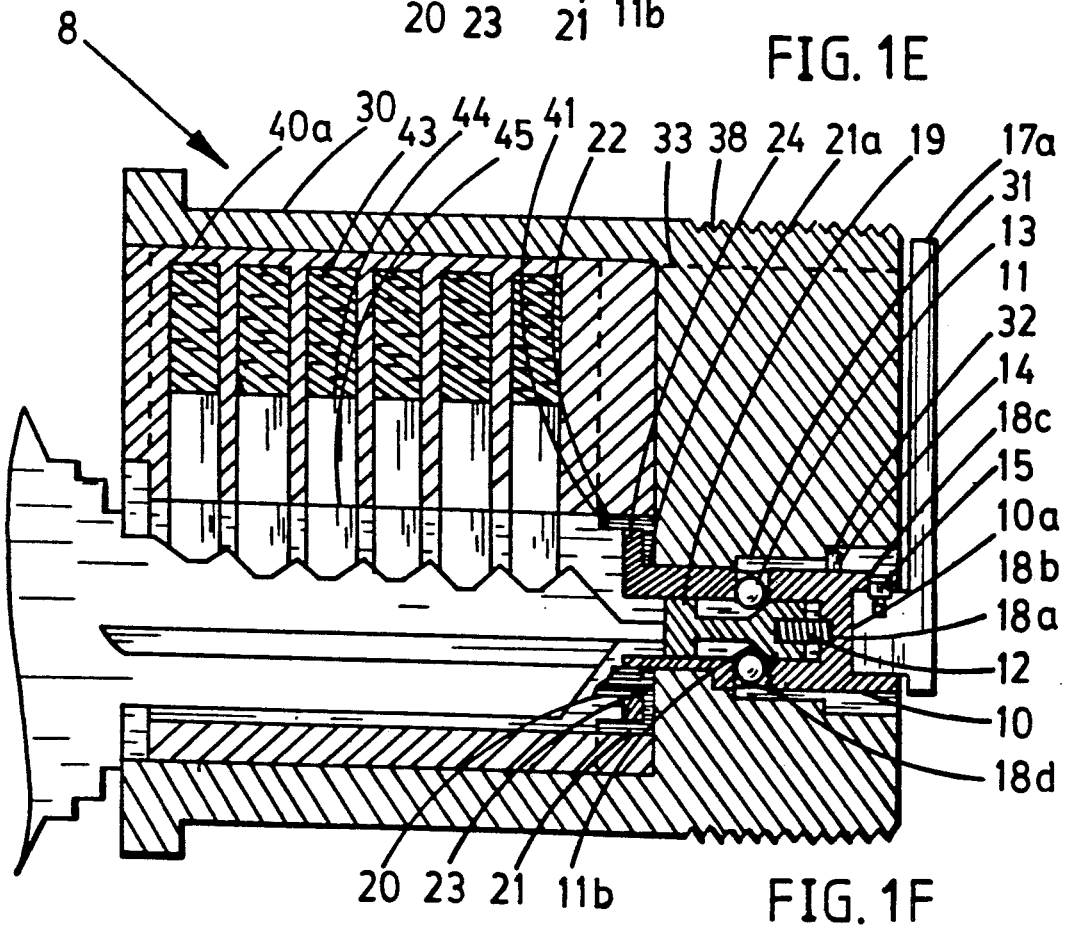
FIG. 1F is a sectional view similar to the one of FIG. 1E, but with a control key inserted.

FIGS. 1E and 1F

In FIG. 1E, lock cylinder 40*a* activates a locking mechanism (not shown), as follows: Standard key 52 is inserted into lock cylinder 40*a* and turned in either direction, depending on the locking mechanism's function. FIG. 1E shows an interchangeable attachment 9 in the non-interchangeable mode. Since cylinder core 9 is directly linked to cam 17, the locking mechanism is activated every time core lock cylinder 40*a* is turned. Since transforming attachment 9 is not in the interchangeable mode, plunger spring 12 is fully extended, thus forcing plunger 11 all the way out to the plunger retaining crimps 29*a* (best seen in FIG. 2C). With plunger 11 fully extended, locking balls 13 are forced all the way out to ball retaining annular recess 31, thus holding interchangeable core lock cylinder 40*a* in place.

FIG. 1F shows cylinder 40*a* in the interchangeable mode. It is released from the cylinder housing and operates as follows: control key 50 is inserted into cylinder 40*a*. This action causes push rod 51 on the tip of control key 50 to come into contact with plunger head 19, thus pushing plunger 11 back to the rear of plunger access hole 18, allowing locking balls 13 to drop into an inner position within plunger 11 (best seen in FIG. 2D). This action is the first phase in freeing cylinder 40*a*. The second and final phase is accomplished when control key 50 is turned approximately five degrees to the right of center. This action moves security back-up pin 14 and cam 17 in line with security back-up pin groove 32 and cam access space 33, respectively, and allows cylinder 40*a* to be withdrawn from cylinder housing 30 using control key 50 as a pull handle.

The provision of the security back-up pin groove and cam access space 33 serve as additional security means which makes it impossible to extract the interchangeable attachment with a wrong control key.

SUMMARY, RAMIFICATIONS & SCOPE

Thus it has been shown that I have provided an attachment for transforming a lock cylinder to have an interchangeable core, the attachment being connected to the end of the conventional core instead of to its lock nut which normally support a lock cam. Instead, the cam is connected to the rear end of the attachment, while the attachment itself functions as an interchangeable disengaging clutch having releasable means for removably connecting the cylinder core to the lock housing and a moveable body in the form of a flanged plunger which is shifted by the control key from the first position, in which it is locked in the cylinder housing, and the second position, in which it is partially prepared for removal from the cylinder housing. In order to make the core completely prepared for disconnection from the housing, a second locking means on the core must be aligned with appropriate aligning slot in the housing by turning the control key by a predetermined angle.

Thus, the reader will see that, according to the invention, I have provided a core lock cylinder attachment which is simple in construction, reliable in operation, and can be attached to a conventional non-intechangeable core lock to make it interchangeable. I have also provided a housing which obviates all of the aforenoted disadvantages of prior interchangeable core lock cylinders. It provides the locksmith with a transformed interchangeable core lock cylinder with one shear line which is easy and uncomplicated to repin, compared to the two shear line type. It is self-contained and totally independent of the cylinder housing, thus providing a means whereby transformed interchangeable lock core cylinders can be easily and conveniently interchanged by individuals not schooled in the locksmith profession. It provides a transformed interchangeable core lock cylinder with the cam attached directly to the core, where it can be easily removed for convenient servicing, without having to remove the cylinder housing. It provides a cylinder housing with an opening all the way through to the inner workings of the lock mechanism for easy and convenient lubrication without having to remove the cylinder housing.

Although the invention has been shown and described with reference to a specific embodiment, it can be fulfilled in many other modifications which do not depart from the scope of the attached claims. For example, the core lock cylinder has been shown installed in a mortising cylinder housing. But it is not limited to the mortising cylinder type alone. Housing 30 can be designed in the form of a rim cylinder, doorknob padlock, or various other type of locks as well, depending on the function desired. Also cam 17 can be shaped so that it can be compatible with the function of these other cylinder housings.

The security back-up pin and its respective groove in the cylinder housing may have different configurations and angular positions.

Thus, the scope of the invention should be determined by the appended claims and their legal equivalents, and not by the examples given.

I claim:

1. An attachment for transforming a lock cylinder to have an interchangeable core, comprising:

a lock cylinder housing having a front end, a central opening at said front end, and a closed rear with an access opening; an aligning member inserted into said central opening and occupying a part of its cross section, said aligning member having a first radial slot containing a plurality of spring-loaded top driver pins;

a cylinder core having a front end, a rear end, a keyway located in said central opening, and a plurality of second radial slots which are aligned with said first radial slots and contain bottom pins; and releasable means for removably connecting said cylinder core to said lock cylinder housing, said releasable means comprising a longitudinal body moveable in the axial direction of said cylinder core between a first axial position in which aid cylinder core is fixed to said housing and a second axial position in which said cylinder core can be removed from said cylinder housing after being turned at a predetermined angle;

resilient means constantly urging said moveable body to said first position;

means for locking said cylinder core to said cylinder housing in said first position;

a cam rigidly connected to said releasable means for engagement with a latch of said lock; and means for connecting said releasable means to said rear end of said cylinder core, said closed end of said cylinder housing having an access hole to permit withdrawal of said releasable means;

said means for locking said cylinder core to said cylinder housing comprising an annular groove formed in said cylinder housing and a plurality of elements in said moveable body which can be shifted radially outwardly from said moveable body into said annular groove under the action of said resilient means when said moveable body is in said first axial position;

said resilient means comprising a cylindrical spring;

said moveable body comprising a cylindrical plunger having a cylindrical portion and a portion outwardly from said cylindrical portion;

said plurality of elements comprising a plurality of balls, so that when said spring urges said plunger into said first axial position, said balls fall into said annular groove and prevent said core from disconnection from said cylinder housing.

2. The attachment of claim 1, further including a second locking means formed on said cylinder core, and an aligning slot in said closed rear end of said cylinder housing formed in a predetermined angular position, so that when said cylinder core is installed into said second axial position and said predetermined angular position, said core can be withdrawn from said cylinder housing; and means for shifting said moveable body to said second axial position, for turning it into said predetermined angular position, and for withdrawing it from said cylinder housing.

3. The attachment of claim 2 wherein said means for shifting, turning, and withdrawing said cylinder core from said cylinder housing comprises a control key.

4. The attachment of claim 3 wherein said control key has at its front end a push rod engageable with said plunger for pushing said plunger into said second axial position.

5. The attachment of claim 1 wherein said means for connecting said releasable means to said cylinder core comprises a flange made on a front end of said releasable means, and a lock nut removably connected to said rear end of said cylinder core, said flange being fixed to said rear end of said cylinder core by said lock nut.

6. An attachment for transforming a lock cylinder to have interchangeable core comprising:

a lock cylinder housing having a front end, a central opening at said front end, and a closed rear end;

an aligning bracket inserted into said central opening and occupying a portion of a cross-section of said central opening, said bracket having a radial slot;

a cylinder core having a front end, a rear end, a key way, a hollow radial projection with a plurality of guide recesses containing spring-loaded top driver pins, said hollow projection being inserted into said radial slot of said aligning bracket, said cylinder core being inserted into said central hole to occupy its remaining cross-section, said cylinder core having a plurality of radial slots which are aligned with said guide recesses and contain bottom pins; and releasable means for removably connecting said cylinder core to said lock cylinder housing, said releasable means comprising a flanged cylinder with a flange on its front end and means for connecting a latch cam at its rear end, said flanged cylinder having a central opening and a longitudinal body moveable in said housing in the axial direction of said cylinder core between a first axial position in which said cylinder core is fixed to said housing and a second axial position in which said cylinder core can be removed from said cylinder housing after turning for a predetermined angle;

resilient means constantly urging said moveable body to said first position;

means for locking said cylinder core to said cylinder housing in said first position; and means for connecting said releasable means to said rear end of said cylinder core, said closed end of said cylinder housing having a releasable means access hole to permit withdrawal of said releasable means from said cylinder housing;

said means for locking said cylinder core to said cylinder housing comprising an annular groove formed in said cylinder housing and a plurality of elements in said moveable body which can be shifted radially outwardly from said moveable body into said annular groove under the action of said resilient means when said moveable body is in said first axial position, said means for locking said releasable means to said core comprising a conventional lock nut which belongs to said cylinder core to which said releasable means tis to be attached, said lock nut having a recess for inserting said flange for connecting said flanged cylinder to said cylinder core so that the cylindrical part of said flanged cylinder extends rearwardly axially from said lock nut.

7. The attachment of claim 6 wherein said resilient means is a cylindrical spring, said moveable body is a cylindrical plunger having a cylindrical portion and a portion outwardly from said cylindrical portion, said plurality of elements comprise a plurality of balls, so that when said spring urges said plunger into said first axial position, said tapering portion is moved forward and said balls fall in said annular groove and thus prevent said core from disconnection from said cylinder housing.

8. The attachment of claim 6, further including a second locking means formed on said cylinder core, and an first aligning slot in said closed rear end of said cylinder housing formed in a predetermined angular position, so that when said cylinder core is installed into said second axial position and said predetermined angular position, said core can be withdrawn from said cylinder housing; and means for shifting said moveable body to said second axial position, for turning it into said predetermined angular position, and for withdrawing it from said cylinder housing.

9. The attachment of claim 8 wherein said second locking means comprises a locking pin extending radially outwardly from said flanged cylinder, said rear closed end of said cylinder having a second aligning slot with configuration which conforms to that of said latch cam, said cam being in the same angular position with respect to said locking pin as said second aligning slot with respect to said first aligning slot, so that said core can be withdrawn together with said releasable means and said latch cam, said means for shifting, turning, and withdrawing said cylinder core from said comprising a control key.

10. The attachment of claim 9 wherein said flanged cylinder has a plurality of lock nut pin access grooves through and behind said flange to provide means whereby said conventional lock nut will be prevented from turning.

11. The attachment of claim 9 wherein said lock nut pin access grooves extend through said flange and continue horizontally along the outer edge of said flanged cylinder one half the distance to said balls, so as to provide a means whereby said cylinder core nut pin can be unseated using a tool having a predetermined configuration.

12. The attachment of claim 11 wherein said flanged cylinder has a plurality of recesses for receiving said balls, said flanged cylinder having an inner wall which divides said flanged cylinder into a front cavity which slidingly receives said plunger and a rear cavity which receives said cam, said spring being located between said plunger and said inner wall.

13. The attachment of claim 12 wherein said front cavity has a plunger retaining crimp in its front end so as to prevent said plunger from coming all the way out of said flanged cylinder.

14. The attachment of claim 12 wherein each of said recesses of said flanged cylinder has a ball crimp in the outside edge so as to prevent said balls from coming all the way out of said ball recesses.

15. The attachment of claim 9 wherein said cylinder housing has a second groove bored behind said annular groove and centered around said releasable means access opening so as to prevent said

16. An attachment for transforming a lock cylinder to have interchangeable core comprising:

a lock cylinder housing having a front end, a central opening at said front end, and a closed rear end; an aligning bracket inserted into said central opening and occupying a portion of a cross-section of said central opening, said bracket having a radial slot;

a cylinder core having a front end, a rear end, a keyway, and a hollow radial projection with a plurality of guide recesses containing spring-loaded top driver pins, said hollow projection being inserted into said radial slot of said aligning bracket, said cylinder core being inserted into said central hole and occupies its remaining cross-section, said cylinder core having a plurality of radial slots which are aligned with said guide recesses and contain bottom pins; and releasable means for removably connecting said cylinder core to said lock cylinder housing, said releasable means comprising a flanged cylinder with a flange on its front end and means for connecting a latch cam at its rear end, said flanged cylinder having a central opening and a longitudinal body moveable in said housing in the axial direction of said cylinder core between a first axial position in which said cylinder core is fixed to said housing and a second axial position in which said cylinder core can be removed from said cylinder housing after turning for a predetermined angle;

resilient means constantly urging said moveable body to said first position;

means for locking said cylinder core to said cylinder housing in said first position; and means for connecting said releasable means to said rear end of said cylinder core, a releasable means access hole being formed in said closed end of said cylinder housing for withdrawing said releasable means from said cylinder housing;

said means for locking said cylinder core to said cylinder housing comprising an annular groove formed in said cylinder housing and a plurality of elements in said moveable body shifted radially outwardly from said moveable body into said annular groove under the action of said resilient means when said moveable body is in said first axial position, said means for locking said releasable means to said core comprising a conventional lock nut which belongs to said cylinder core to which said releasable means is to be attached, said lock nut having a recess for inserting said flange for connecting said flanged cylinder to said cylinder core so that the cylindrical part of said flanged cylinder extends rearwardly axially from said lock nut;

said resilient means comprising a cylindrical spring, said moveable body comprising a cylindrical plunger having a cylindrical portion and a portion outwardly from said cylindrical portion, said plurality of elements comprising a plurality of balls, so that when said spring urges said plunger into said first axial position, said tapering portion is moved forward and said balls fall into said annular groove and thus prevent said core from disconnection from said cylinder housing, said attachment further including a second locking means formed on said cylinder core, and an first aligning slot in said closed rear end of said cylinder housing formed in a predetermined angular position, so that when said cylinder core is installed into said second axial position and said predetermined angular position, said core can be withdrawn from said cylinder housing; and means for shifting said moveable body to said second axial position for turning it into said predetermined angular position and for withdrawing it from said cylinder housing.

17. The attachment of claim 16 wherein said second locking means comprises a locking pin extending radially outwardly from said flanged cylinder, said rear closed end of said cylinder having a second aligning slot with configuration which conforms to that of said latch cam, said cam being in the same angular position with respect to said locking pin as said second aligning slot with respect to said first aligning slot, so that said core can be withdrawn together with said releasable means and said latch cam, said means for shifting, turning, and withdrawing said cylinder core from said cylinder housing comprising a control key, said flanged cylinder having a plurality of lock nut pin access grooves through and behind said flange to provide means whereby said conventional lock nut will be prevented from turning, said lock nut pin access grooves extend through said flange and continue horizontally along the outer edge of said flanged cylinder one half the distance to said balls, so as to provide a means whereby said cylinder core nut pin can be unseated with a tool having a predetermined shape.

18. The attachment of claim 17 wherein said flanged cylinder has a plurality of recesses for receiving said balls, said flanged cylinder having an inner wall which divides said flanged cylinder into a front cavity which slidingly receives said plunger and a rear cavity which receives said cam, said spring being located between said plunger and said inner wall.

19. The attachment of claim 18 wherein said front cavity has a plunger retaining crimp in its front end so as to prevent said plunger from coming all the way out of said flanged cylinder, each said recesses of said flanged cylinder having a ball crimp in its outside edge so as to prevent said balls from coming all the way out of said ball recesses.

20. The attachment of claim 19 wherein said cylinder housing has a second groove bored behind said annular groove and centered around said releasable means access opening so as to provide a means whereby said attachment cannot be removed with an unauthorized control key.

* * * * *